US011781719B2

(12) United States Patent
Han et al.

(10) Patent No.: US 11,781,719 B2
(45) Date of Patent: Oct. 10, 2023

(54) VEHICLE LAMP

(71) Applicant: SL Corporation, Daegu (KR)

(72) Inventors: Hyo Jin Han, Gyeongsan-si (KR); Kyung Su Lee, Gyeongsan-si (KR)

(73) Assignee: SL Corporation, Daegu (KR)

( * ) Notice: Subject to any disclaimer, the term of this patent is extended or adjusted under 35 U.S.C. 154(b) by 0 days.

(21) Appl. No.: 17/743,569

(22) Filed: May 13, 2022

(65) Prior Publication Data

US 2023/0073488 A1 Mar. 9, 2023

(30) Foreign Application Priority Data

Sep. 8, 2021 (KR) ..... 10-2021-0119471

(51) Int. Cl.
*F21S 41/10* (2018.01)
*F21S 41/25* (2018.01)
*F21W 102/10* (2018.01)

(52) U.S. Cl.
CPC ..... *F21S 41/10* (2018.01); *F21S 41/25* (2018.01); *F21W 2102/10* (2018.01)

(58) Field of Classification Search
CPC .. F21S 41/10; F21S 41/25; F21S 41/47; F21S 41/147; F21S 41/151
See application file for complete search history.

(56) References Cited

U.S. PATENT DOCUMENTS

| | | | | |
|---|---|---|---|---|
| 7,204,628 | B2 * | 4/2007 | Ishida | F21S 41/147 362/545 |
| 8,251,560 | B2 * | 8/2012 | Ohno | F21S 2/005 362/509 |
| 10,082,272 | B2 * | 9/2018 | Gromfeld | F21S 41/24 |
| 10,260,694 | B2 * | 4/2019 | Kasano | F21S 41/255 |
| 10,955,102 | B1 * | 3/2021 | Lee | F21S 41/151 |
| 2021/0180760 | A1 * | 6/2021 | Aubert | F21S 41/151 |
| 2022/0243890 | A1 * | 8/2022 | Jars | F21S 41/29 |

* cited by examiner

*Primary Examiner* — Matthew J. Peerce
(74) *Attorney, Agent, or Firm* — United One Law Group LLC; Kongsik Kim; Jhongwoo Peck

(57) ABSTRACT

A lamp for a vehicle includes a first lamp unit that forms a first region of a beam pattern using a plurality of first lamp modules arranged along a width direction of the vehicle; and a second lamp unit that is disposed more outward than the first lamp unit along the width direction of the vehicle and forms a second region of the beam pattern using a plurality of second lamp modules arranged along the width direction of the vehicle.

10 Claims, 12 Drawing Sheets

FIG. 12

| TILTING OR NO | LIGHTING IMAGE |
| --- | --- |
| NON-TILTING | I' |
| TILTING | I |

VEHICLE LAMP

CROSS REFERENCE TO RELATED APPLICATION

This application claims priority from Korean Patent Application No. 10-2021-0119471 filed on Sep. 8, 2021, which application is incorporated herein by reference in its entirety.

BACKGROUND

1. Technical Field

The present disclosure relates to a vehicle lamp, and more specifically, to a vehicle lamp that allows implementation of a slim design while being able to form an optimum beam pattern.

2. Description of the Related Art

In vehicles, various types of lamps are provided for illumination functions for drivers to easily check objects around the vehicles during low-light conditions (e.g., night-time driving) and signaling functions for notifying nearby vehicles and pedestrians of driving states of the vehicles.

For example, the main purpose of head lamps, fog lamps, and the like is to perform the illumination function, and the main purpose of daytime running lamps, position lamps, turn signal lamps, tail lamps, brake lamps, and the like is to perform the signaling function. The installation standards and regulations are defined by laws to ensure that the lamps sufficiently perform the required functions.

Recently, not only a functional aspect of a vehicle lamp that allows a driver to secure visibility to help safe driving, which is a basic function of the vehicle lamp, but also an aesthetic aspect that a consumer feels with regard to the design greatly affect the decision to purchase a vehicle.

To this end, studies on improving an exterior design by making a vehicle lamp to have a slimmer design are actively being carried out, and a method of not only implementing a slim form factor but also forming an optimum beam pattern using a plurality of lamp modules is sought.

SUMMARY

Aspects of the present disclosure provide a vehicle lamp in which a plurality of lamp modules disposed in a vehicle width direction have one or more optical axes that are positioned to be tilted by predetermined angles to implement a slim design and to form an optimum beam pattern.

Objectives of the present disclosure are not limited to the above-described objective, and other objectives of the present disclosure will be clearly apparent to those skilled in the art from the following descriptions.

According to an aspect of the present disclosure, a vehicle lamp may include a first lamp unit that forms a first region of a beam pattern, the first lamp unit including a plurality of first lamp modules arranged along a width direction of a vehicle; and a second lamp unit that is disposed more outward than the first lamp unit in the width direction of the vehicle and forms a second region of the beam pattern, the second lamp unit including a plurality of second lamp modules arranged along the width direction of the vehicle.

The plurality of first lamp modules may be divided into a first group and a second group. The first group may include one or more first lamp modules disposed more inward than one or more first lamp modules included in the second group. Further, optical axes of the first lamp modules belonging to the first group may be tilted in a first direction with respect to a reference direction, and optical axes of the first lamp modules belonging to the second group may be tilted in a second direction different from the first direction with respect to the reference direction.

Herein, the reference direction may be a front-rear direction. The first direction may be a direction toward an inner side of the vehicle with respect to the reference direction, and the second direction may be a direction toward an outer side of the vehicle with respect to the reference direction.

The first lamp modules belonging to the first group may be configured with tilting angles in the first direction that progressively increase toward the inner side of the vehicle, and the first lamp modules belonging to the second group may be configured with tilting angles in the second direction that progressively increase toward the outer side of the vehicle.

Further, one or more of the plurality of first lamp modules may be included in a third group, which is disposed between the first group and the second group, and an optical axis of the first lamp module belonging to the third group may be parallel to the reference direction.

Optical axes of one or more second lamp modules disposed adjacent to the first lamp unit among the plurality of second lamp modules of the second lamp unit may be tilted by smaller angles in the second direction with respect to the reference direction than an outermost first lamp module disposed adjacent to the second lamp unit among the plurality of first lamp modules of the first lamp unit.

Among the plurality of second lamp modules, one or more second lamp modules adjacent to the first lamp unit may be configured so that optical axes of the one or more second lamp modules have tilting angles in the second direction with respect to the reference direction that progressively decrease toward the outer side of the vehicle.

The plurality of first lamp modules and the plurality of second lamp modules may be disposed progressively more rearward going toward the outer side of the vehicle.

Each of the plurality of first lamp modules and the plurality of second lamp modules may include a light source component that generates light; a lens component that transmits the light generated from the light source component; and a shield component that obstructs at least a part of the light that travels from the light source component toward the lens component.

The shield component may include a stepped portion on a surface thereof that obstructs the light such that the surface has two sides having different heights, and the stepped portion may be disposed with a predetermined offset in one direction from an optical axis of the lens component based on an angle by which the optical axis of the lens component is tilted with respect to the reference direction.

The plurality of first lamp modules and the plurality of second lamp modules may be disposed progressively more rearward going toward the outer side of the vehicle, and the lens components in the plurality of first lamp modules and the plurality of second lamp modules may have front-to-rear thicknesses that progressively increase going toward the outer side of the vehicle.

BRIEF DESCRIPTION OF THE DRAWINGS

The above and other aspects and features of the present disclosure will become more apparent by describing exemplary embodiments in detail with reference to the attached drawings, in which:

FIG. 12 is a schematic view illustrating a lighting image viewed from the observation direction of FIG. 11.

DETAILED DESCRIPTION

Figure 1:
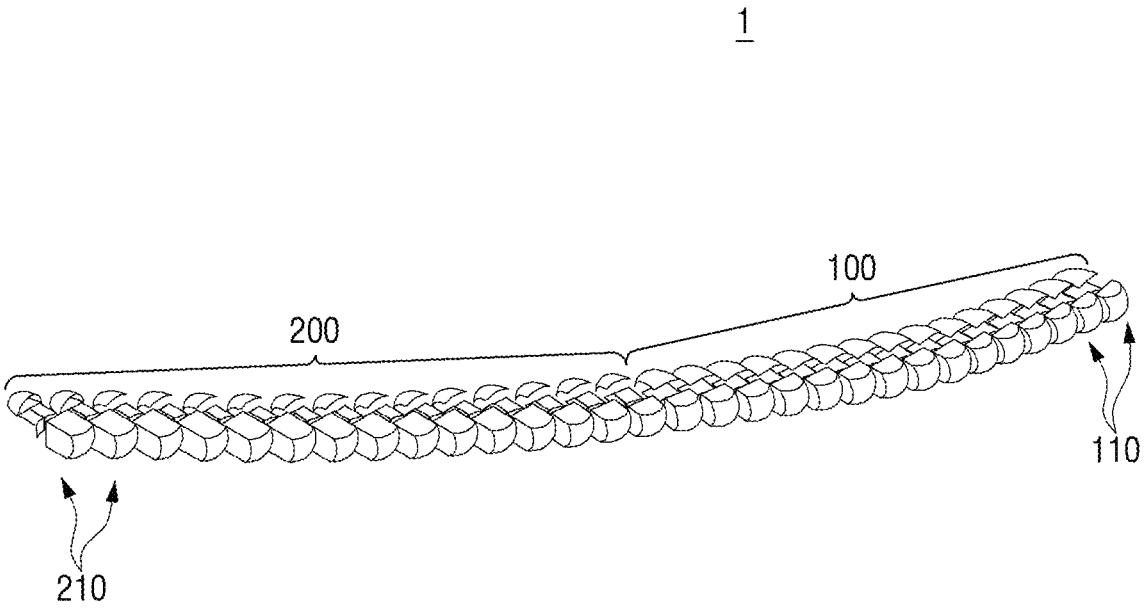
FIG. 1 is a perspective view illustrating a vehicle lamp according to an exemplary embodiment of the present disclosure.

Advantages and features of the present invention and methods of accomplishing the same may be understood more readily by reference to the following detailed description of exemplary embodiments and the accompanying drawings. The present invention may, however, be embodied in many different forms and should not be construed as being limited to the exemplary embodiments set forth herein. Rather, these exemplary embodiments are provided so that this disclosure will be thorough and complete and will fully convey the concept of the invention to those skilled in the art, and the present invention will only be defined by the appended claims. Throughout the specification, like reference numerals in the drawings denote like elements.

In some exemplary embodiments, well-known steps, structures and techniques will not be described in detail to avoid obscuring the invention.

The terminology used herein is for the purpose of describing particular exemplary embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Exemplary embodiments of the disclosure are described herein with reference to plan and cross-section illustrations that are schematic illustrations of idealized exemplary embodiments. As such, variations from the shapes of the illustrations as a result, for example, of manufacturing techniques and/or tolerances, are to be expected. Thus, exemplary embodiments should not be construed as limited to the particular shapes of regions illustrated herein but are to include deviations in shapes that result, for example, from manufacturing. In the drawings, respective components may be enlarged or reduced in size for convenience of explanation.

Hereinafter, the present disclosure will be described with reference to the accompanying drawings for a vehicle lamp according to an exemplary embodiment of the present disclosure.

Figure 2:
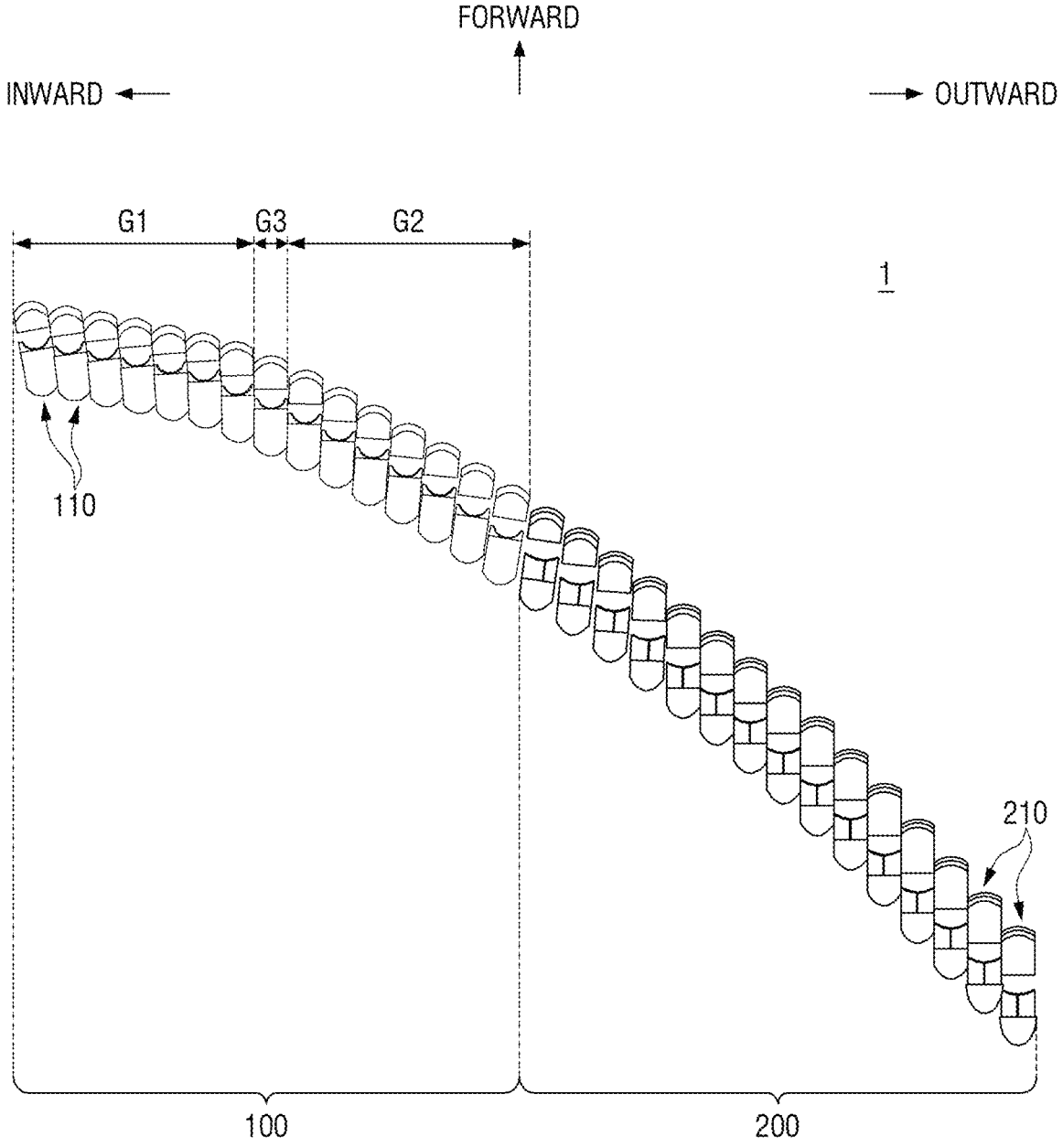
FIG. 2 is a plan view illustrating the vehicle lamp according to the exemplary embodiment of the present disclosure.

FIG. 1 is a perspective view illustrating a vehicle lamp according to the exemplary embodiment of the present disclosure, and FIG. 2 is a plan view illustrating the vehicle lamp according to the exemplary embodiment of the present disclosure.

Referring to FIGS. 1 and 2, a vehicle lamp 1 according to the exemplary embodiment of the present disclosure 1 may include a first lamp unit 100 and a second lamp unit 200. In the exemplary embodiment of the present disclosure, an example in which the vehicle lamp 1 functions as a head lamp that emits light in a driving direction of a vehicle to secure front visibility will be described. However, the present disclosure is not limited thereto, and the vehicle lamp 1 of the present disclosure may function as any lamps such as a tail lamp, a daytime running lamp, a position lamp, a turn signal lamp, a backup lamp, a brake lamp, and a fog lamp installed in the vehicle for various purposes in addition to the head lamp.

When the vehicle lamp 1 of the present disclosure is used as a head lamp, the vehicle lamp 1 of the present disclosure may form a low beam pattern by emitting light to a lower side with respect to a predetermined cutoff line to avoid blinding (e.g., dazzling) a driver of a vehicle in front, such as a proceeding vehicle or an on-coming vehicle, and to secure a wider visibility range in front of the vehicle. When the vehicle lamp 1 of the present disclosure is used as a head lamp, it may also form a high beam pattern to secure a longer visibility distance in front of the vehicle.

Figure 3:
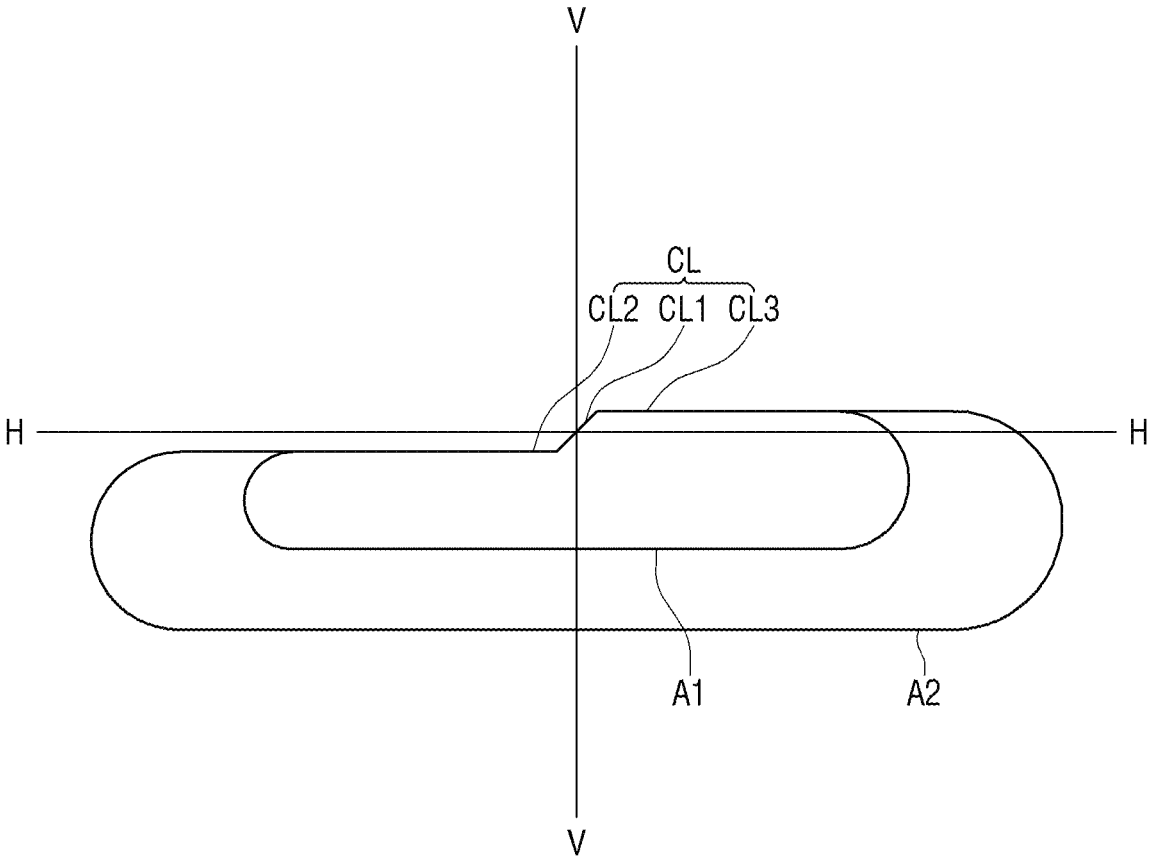
FIG. 3 is a schematic view illustrating a beam pattern formed by the vehicle lamp according to the exemplary embodiment of the present disclosure.

Hereinafter, in the exemplary embodiment of the present disclosure, an example in which the vehicle lamp 1 of the present disclosure forms the low beam pattern by emitting the light to the lower side with respect to a predetermined cutoff line CL as shown in FIG. 3 will be described. The low beam pattern may include a high brightness region A1 which secures a sufficient visibility distance and a spread region A2 which expands the visibility range by expanding the high brightness region A1 in at least one direction of a left-right direction and an up-down direction.

The first lamp unit 100 and the second lamp unit 200 may be disposed in a width direction of the vehicle and may contribute to different regions of the beam pattern formed by the vehicle lamp 1 of the present disclosure.

In the exemplary embodiment of the present disclosure, the first lamp unit 100 may be disposed more inward than the second lamp unit 200 along the vehicle's width direction and may form the spread region A2 of the low beam pattern, and the second lamp unit 200 may form the high brightness region A1 of the low beam pattern. However, the present disclosure is not limited thereto, and positions of the first lamp unit 100 and the second lamp unit 200 or the regions formed by the first lamp unit 100 and the second lamp unit 200 may vary according to a beam pattern to be formed by the vehicle lamp 1 of the present disclosure.

In addition, in the exemplary embodiment of the present disclosure, an example in which the first lamp unit 100 and the second lamp unit 200 form different regions in one beam pattern will be described, but the present disclosure is not limited thereto. The first lamp unit 100 and the second lamp unit 200 may form beam patterns used for different purposes (i.e., two or more separate beam patterns).

In an example, the first lamp unit 100 may include a plurality of first lamp modules 110 that are arranged along the width direction of the vehicle, and the second lamp unit 200 may include a plurality of second lamp modules 210 that are arranged along the width direction of the vehicle. Further, the plurality of first lamp modules 110 and the plurality of second lamp modules 210 may be disposed more rearward going from an inner side toward an outer side of the vehicle. Such a configuration may allow the vehicle lamp 1 of the present disclosure to be accommodated in a space formed by a lamp housing (not shown) and a cover lens (not shown) coupled to the lamp housing and to be disposed in conformity with a shape of an exterior surface of the cover lens that forms a part of the body line of the vehicle. In addition, positions at which the plurality of first lamp modules 110 and the plurality of second lamp modules 210 are disposed may vary according to the body line of the vehicle.

Figure 4:
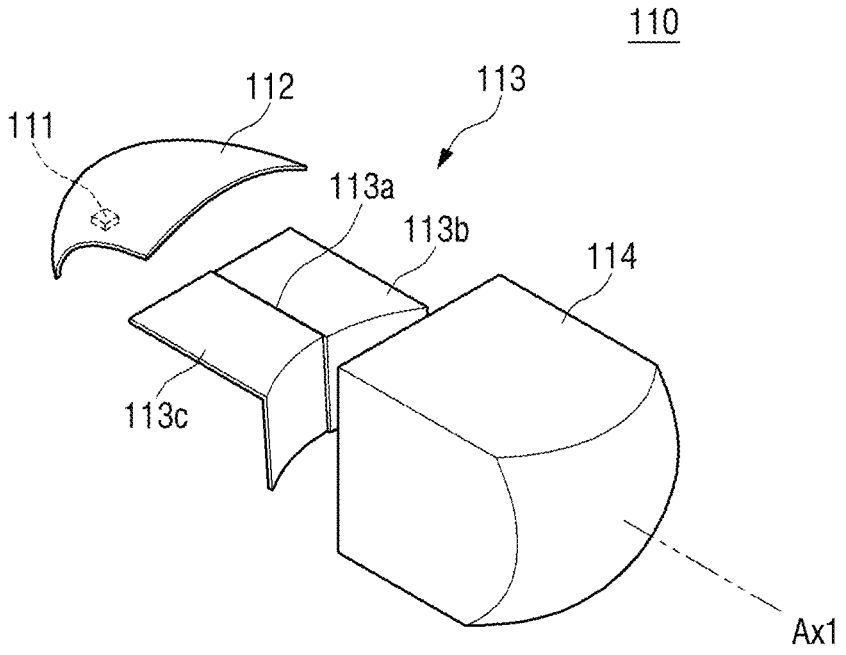
FIG. 4 is a perspective view illustrating a first lamp module according to an exemplary embodiment of the present disclosure.
Figure 5:
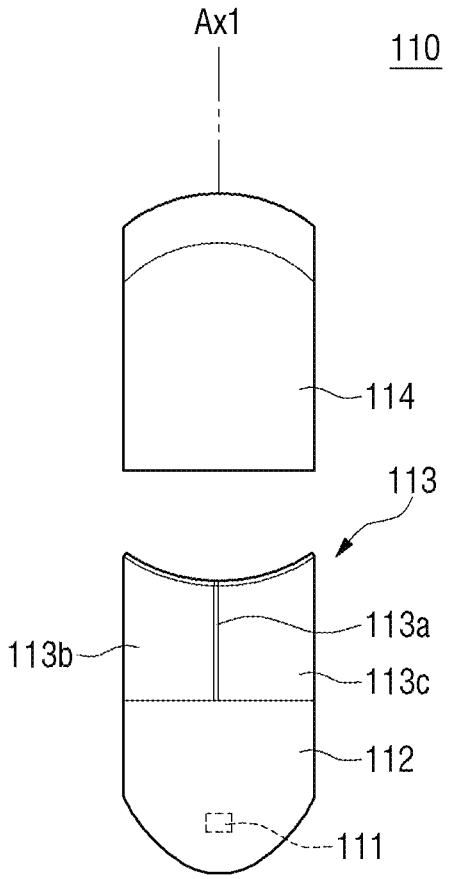
FIG. 5 is a plan view illustrating the first lamp module according to the exemplary embodiment of the present disclosure.
Figure 6:
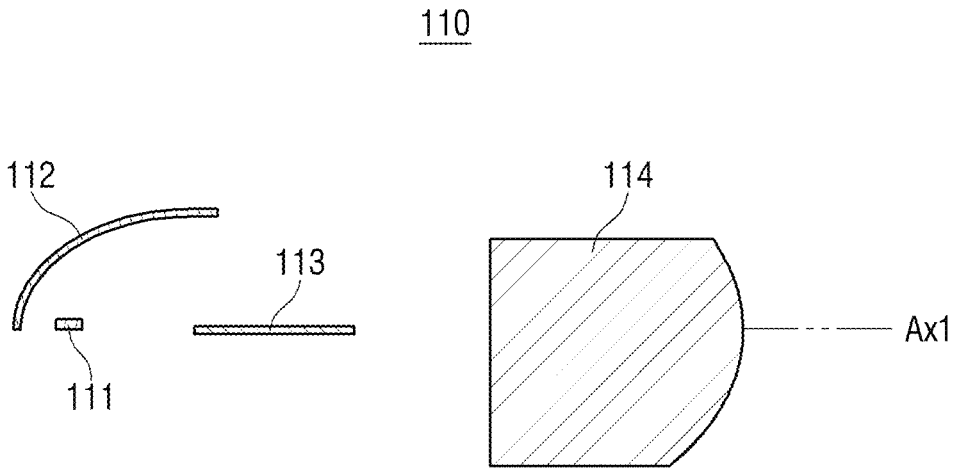
FIG. 6 is a cross-sectional side view illustrating the first lamp module according to the exemplary embodiment of the present disclosure.

FIG. 4 is a perspective view illustrating the first lamp module according to the exemplary embodiment of the present disclosure, FIG. 5 is a plan view (e.g., a top view) illustrating the first lamp module according to the exemplary embodiment of the present disclosure, and FIG. 6 is a cross-sectional side view illustrating the first lamp module according to the exemplary embodiment of the present disclosure. FIGS. 4 to 6 illustrate an example of one of the plurality of first lamp modules 110.

Referring to FIGS. 4 to 6, the first lamp module 110 according to the exemplary embodiment of the present disclosure may include a light source component 111, an optical path adjusting component 112, a shield component 113, and a lens component 114.

The light source component 111 may include one or more light sources for generating light having a quantity and/or color of light suitable for the beam pattern formed by the vehicle lamp 1 of the present disclosure. In the exemplary embodiment of the present disclosure, an example in which the one or more light sources use semiconductor light emitting elements such as a light emitting diode (LED) will be described. However, the present disclosure is not limited thereto, and the one or more light sources may use various types of light sources such as a laser diode (LD) and a bulb.

The optical path adjusting component 112 may adjust an optical path so that the light generated by the light source component 111 may travel toward the lens component 114. In the exemplary embodiment of the present disclosure, an example in which the optical path adjusting component 112 is formed as a reflector that reflects the light from the light source component 111 will be described. As such, the optical path adjusting component 112 may allow the light that travels upward from the light source component 111 to be reflected toward the lens component 114 disposed in front of the light source component 111. In case the light generated by the light source component 111 directly travels toward the lens component 114, the optical path adjusting component 112 may be omitted. The optical path adjusting component 112 may be implemented as various types of optical elements such as a mirror and a prism, which are capable of adjusting an optical path, in addition to the reflector.

The shield component 113 may block (e.g., obstruct) at least a part of the light traveling toward the lens component 114. In the exemplary embodiment of the present disclosure, an example in which a predetermined cutoff line is formed due to the light blocked by the shield component 113 will be described.

A front end of the shield component 113 may have a curved shape following a rear focal surface of the lens component 114, such that both outer portions are closer to the lens component 114 than a center portion. Further, on a surface (e.g., a top surface) of the shield component 113 by which the light is blocked, a stepped portion 113*a* may be formed such that the surface has two planes having different elevations.

In the exemplary embodiment of the present disclosure, due to the stepped portion 113*a* formed in the shield component 113, the cutoff line CL may exhibit an inclined line CL1, a lower line CL2, and an upper line CL3 as described above with reference to FIG. 3. In this case, the inclined line CL1 may be formed by the stepped portion 113*a*, the upper line CL3 may be formed by a lower surface 113*b* that horizontally extends from a lower end of the stepped portion 113*a*, and the lower line CL2 may be formed by an upper surface 113*c* that horizontally extends from an upper end of the stepped portion 113*a*. In particular, it will be understood that the lower line CL2 corresponds to an opposite lane, and the upper line CL3 corresponds to a proceeding lane of the vehicle.

The stepped portion 113*a* may be formed along an optical axis Ax1 of the lens component 114, and an optical axis of the first lamp module 110 may be understood as the optical axis Ax1 of the lens component 114.

In the above-described shield component 113, a position of the stepped portion 113*a* may vary so that the cutoff line CL is formed at a predetermined, correct position even when a direction of the optical axis Ax1 of the first lamp module 110 varies.

Figure 7:
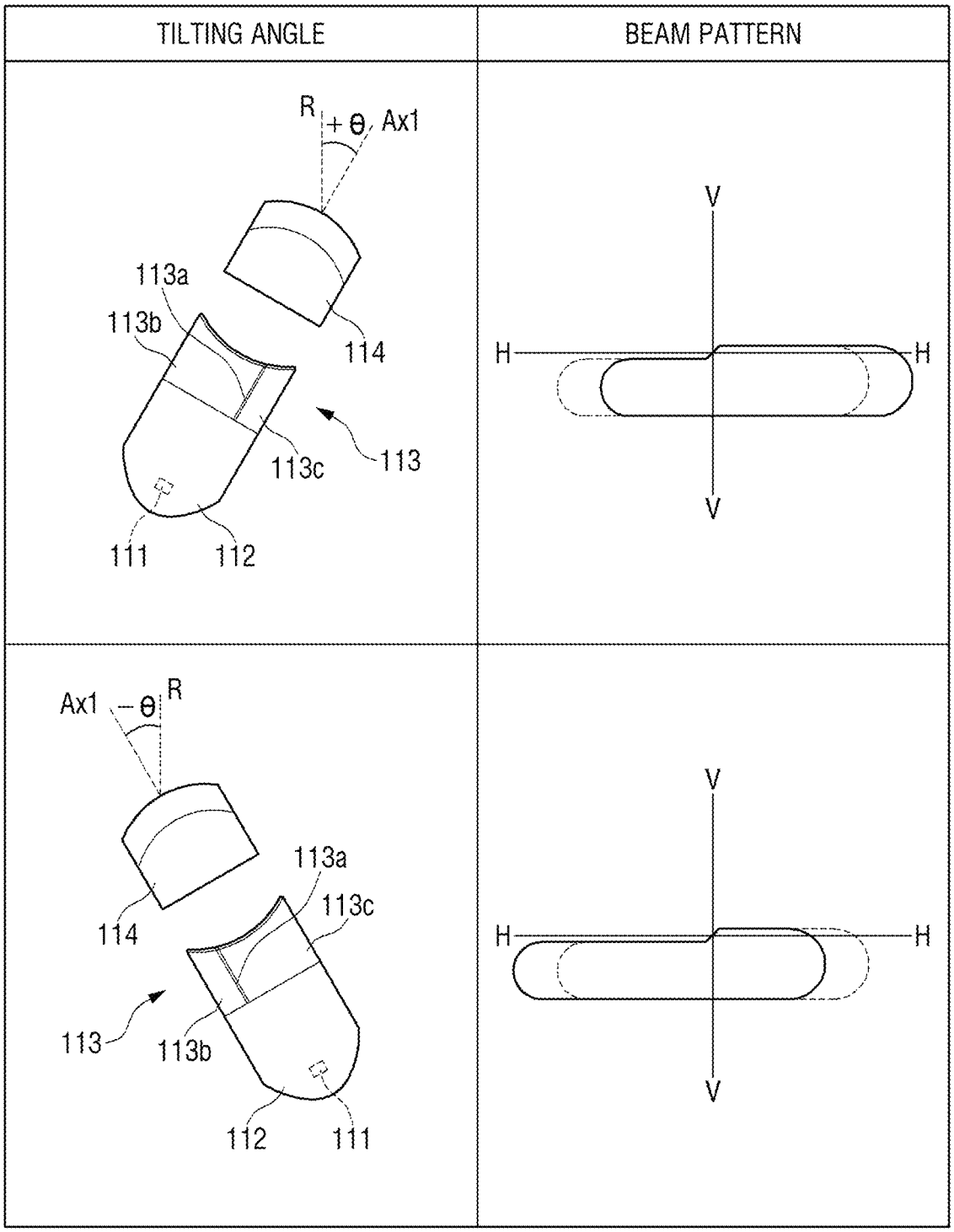
FIG. 7 is a schematic view illustrating a position of a stepped portion corresponding to an optical axis direction of the first lamp module according to the exemplary embodiment of the present disclosure.

FIG. 7 is a schematic view illustrating the position of the stepped portion corresponding to a direction of the optical axis of the first lamp module according to the exemplary embodiment of the present disclosure.

In case the optical axis Ax1 of the first lamp module 110 is tilted by a predetermined angle with respect to a reference direction R, a position of the cutoff line CL may deviate from the position depicted in FIG. 3. In such a case, a driver of a front vehicle may be blinded, or sufficient visibility may not be secured. Even when the optical axis Ax1 of the first lamp module 110 is tilted by the predetermined angle with respect to the reference direction R, the cutoff line CL needs to be formed at the correct position. To this end, when the optical axis Ax1 of the first lamp module 110 is tilted by the predetermined angle with respect to the reference direction R, the stepped portion 113*a* may be disposed to be spaced apart from the optical axis Ax1 of the first lamp module 110 by a predetermined offset in a lateral direction.

Hereinafter, in the exemplary embodiment of the present disclosure, an example in which the reference direction R is a front-rear direction will be described. However, this configuration is merely to facilitate understanding of the present disclosure, and the present disclosure is not limited thereto. The absolute direction of the reference direction R may vary based on an installation position and/or orientation of the vehicle lamp 1 of the present disclosure.

In other words, when the optical axis Ax1 of the first lamp module 110 is parallel to the reference direction R, the stepped portion 113*a* may be formed along the optical axis Ax1 of the first lamp module 110, but when the optical axis Ax1 of the first lamp module 110 is tilted inward or outward with respect to the reference direction R, the stepped portion 113*a* may be disposed offset from the optical axis Ax1 of the first lamp module 110 inward or outward to adjust the width of the lower line CL2 and/or the upper line CL3 so that the cutoff line CL may be formed at the correct position even when the optical axis Ax1 of the first lamp module 110 is tilted with respect to the reference direction R.

In the right-hand side column of FIG. 7, broken lines depict a beam pattern when the optical axis Ax1 of the first lamp module 110 is positioned parallel to the reference direction R so that the stepped portion 113*a* is formed along the optical axis Ax1 of the lens component 114. In addition, in the left-hand side column of FIG. 7, it can be seen that sizes of the lower surface 113*b* and the upper surface 113*c* with respect to the stepped portion 113*a* are different, and the cutoff line CL is formed at the correct position in a direction in which the stepped portion 113*a* is spaced apart from the optical axis Ax1 of the first lamp module 110.

In addition, in FIG. 7, angles "+0" and "−0" denote tilting angles of the first lamp module 110, and a positive sign (+) or a negative sign (−) of the tilting angle indicates a direction to which the optical axis Ax1 of the first lamp module 110 is tilted with respect to the reference direction R. For example, the tilting angle may have a positive sign when the first lamp module 110 is tilted toward the outer side of the vehicle with respect to the reference direction R (see the upper row in FIG. 7), and conversely, the tilting angle may have a negative sign when the first lamp module 110 is tilted toward the inner side of the vehicle with respect to the reference direction R (see the lower row in FIG. 7).

The lens component 114 may transmit light incident past the shield component 113 to form a beam pattern suitable for the use of the vehicle lamp 1 of the present disclosure. In the exemplary embodiment of the present disclosure, since the plurality of first lamp modules 110 and the plurality of second lamp modules 210 are disposed more rearward going from the inner side toward the outer side of the vehicle, the lens components 114 may be formed to be thicker in the front-rear direction as they go toward the outer side of the vehicle.

In the first lamp unit 100, one or more first lamp modules disposed closer to the inner side of the vehicle along the width direction of the vehicle may constitute a first group G1, and one or more first lamp modules disposed closer to the outer side of the vehicle may constitute a second group G2. Among the plurality of first lamp modules 110, the first lamp modules belonging to the first group G1 may be configured so that optical axes of the first lamp modules belonging to the first group G1 are tilted in a first direction with respect to the reference direction R, and the first lamp modules belonging to the second group G2 may be configured so that optical axes of the first lamp modules belonging to the second group G2 are tilted in a second direction with respect to the reference direction R.

For example, the first direction may be a direction toward the inner side of the vehicle with respect to the front-rear direction, and the second direction may be a direction toward the outer side of the vehicle in the front-rear direction.

Meanwhile, in the first lamp unit 100 according to the exemplary embodiment of the present disclosure, a third group G3 may be disposed between the first group G1 and the second group G2, and the first lamp module belonging to the third group G3 among the plurality of first lamp modules 110 may be configured so that an optical axis of the first lamp module belonging to the third group G3 is parallel to the front-rear direction (i.e., the reference direction R).

In the exemplary embodiment of the present disclosure, since the optical axes Ax1 of the first lamp modules belonging to the first group G1 and the second group G2 are tilted by predetermined angles with respect to the reference direction R, a slim form factor may be implemented, the spread characteristics of a beam pattern may be improved, and a lighting image may be improved overall.

In other words, when all of the optical axes Ax1 of the plurality of first lamp modules 110 are parallel to the front-rear direction, the light may be concentrated in front of the vehicle, thereby increasing a visibility distance. However, since a visibility range in the left-right direction may be relatively limited, the optical axes Ax1 of some of the plurality of first lamp modules 110 in the exemplary embodiment of the present disclosure may be tilted by the predetermined angles with respect to the reference direction R, thereby increasing a light-emitting range in the left-right direction so that a visibility range may be increased.

In addition, when all of the optical axes Ax1 of the plurality of first lamp modules 110 are parallel to the reference direction R, a perfect (e.g., substantially complete, full, or whole) lighting image may be observed when viewed from the front of the vehicle lamp, which is the reference direction R. However, when viewed from a direction tilted with respect to the reference direction R, an imperfect (e.g., incomplete, less than full, or deficient) lighting image may be observed. To avoid or mitigate such a problem, the optical axes Ax1 of the first lamp module belonging to the first group G1 and the second group G2 may be tilted by the predetermined angles with respect to the reference direction R such that a perfect lighting image may be perceived even when a direction from which the vehicle lamp 1 of the present disclosure is viewed varies.

For example, when the vehicle lamp 1 of the present disclosure is used for the purpose of a head lamp, a perfect lighting image may be observed when viewed from the front of the vehicle, but a relatively imperfect lighting image may be observed when viewed from one side of the front of the vehicle because some light of the plurality of first lamp modules 110 may not be observed. To overcome such a potential problem, the optical axes Ax1 of the first lamp modules belonging to the first group G1 and the second group G2 may be tilted by the predetermined angles with respect to the front-rear direction.

In some exemplary embodiments, among the plurality of first lamp modules 110, the first lamp modules belonging to the first group G1 may be configured so that the optical axes Ax1 of the first lamp modules belonging to the first group G1 are tilted toward the inner side of the vehicle with respect to the reference direction R by progressively increasing angles as they go toward the inner side of the vehicle. Similarly, the first lamp modules belonging to the second group G2 may be configured so that the optical axes Ax1 of the first lamp modules belonging to the second group G2 are tilted toward the outer side of the vehicle with respect to the reference direction R by progressively increasing angles as they go toward the outer side of the vehicle.

Figure 8:
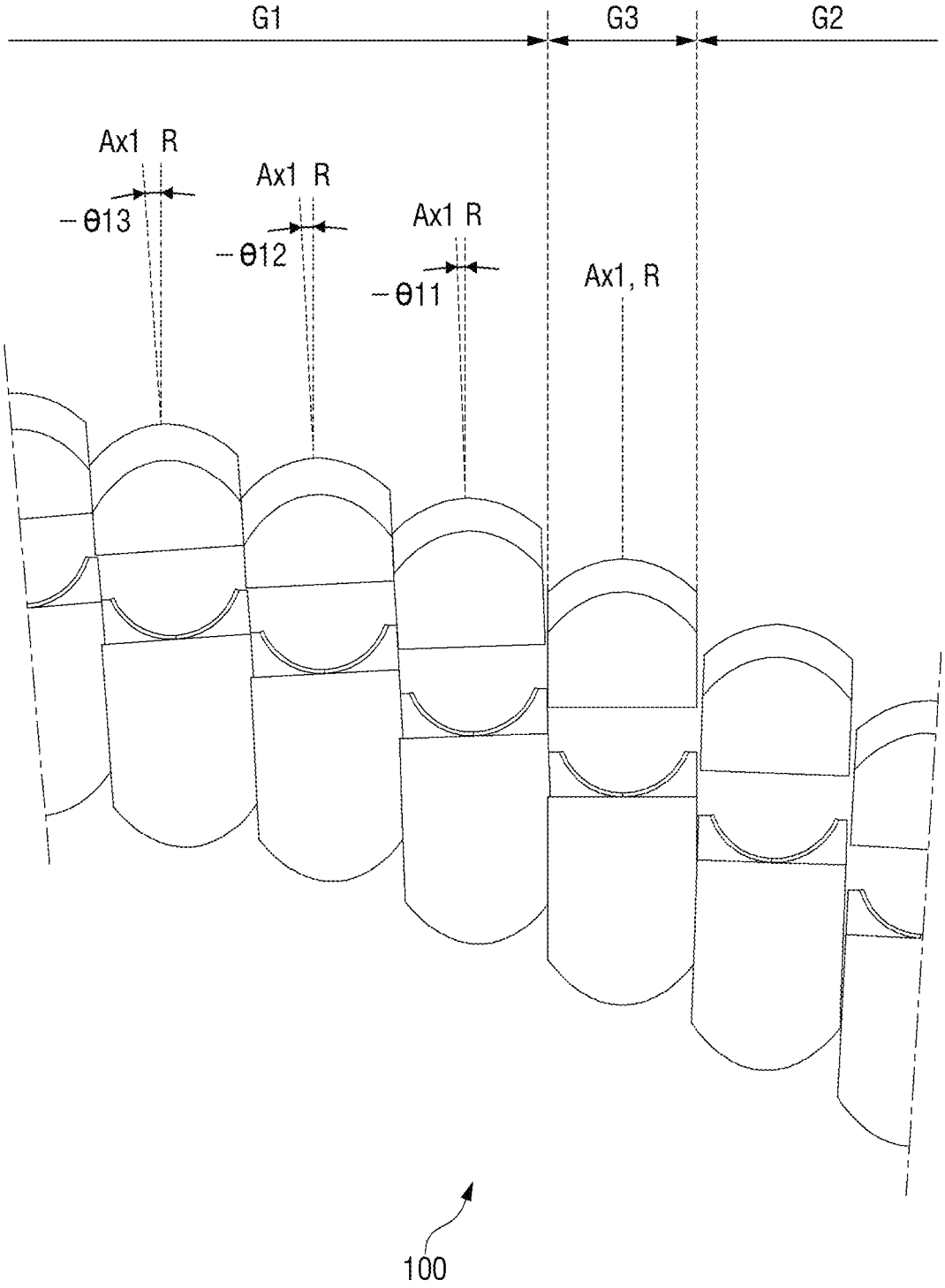
FIG. 8 is a schematic view illustrating optical axes of first lamp modules included in a first group of a first lamp unit according to the exemplary embodiment of the present disclosure.
Figure 9:
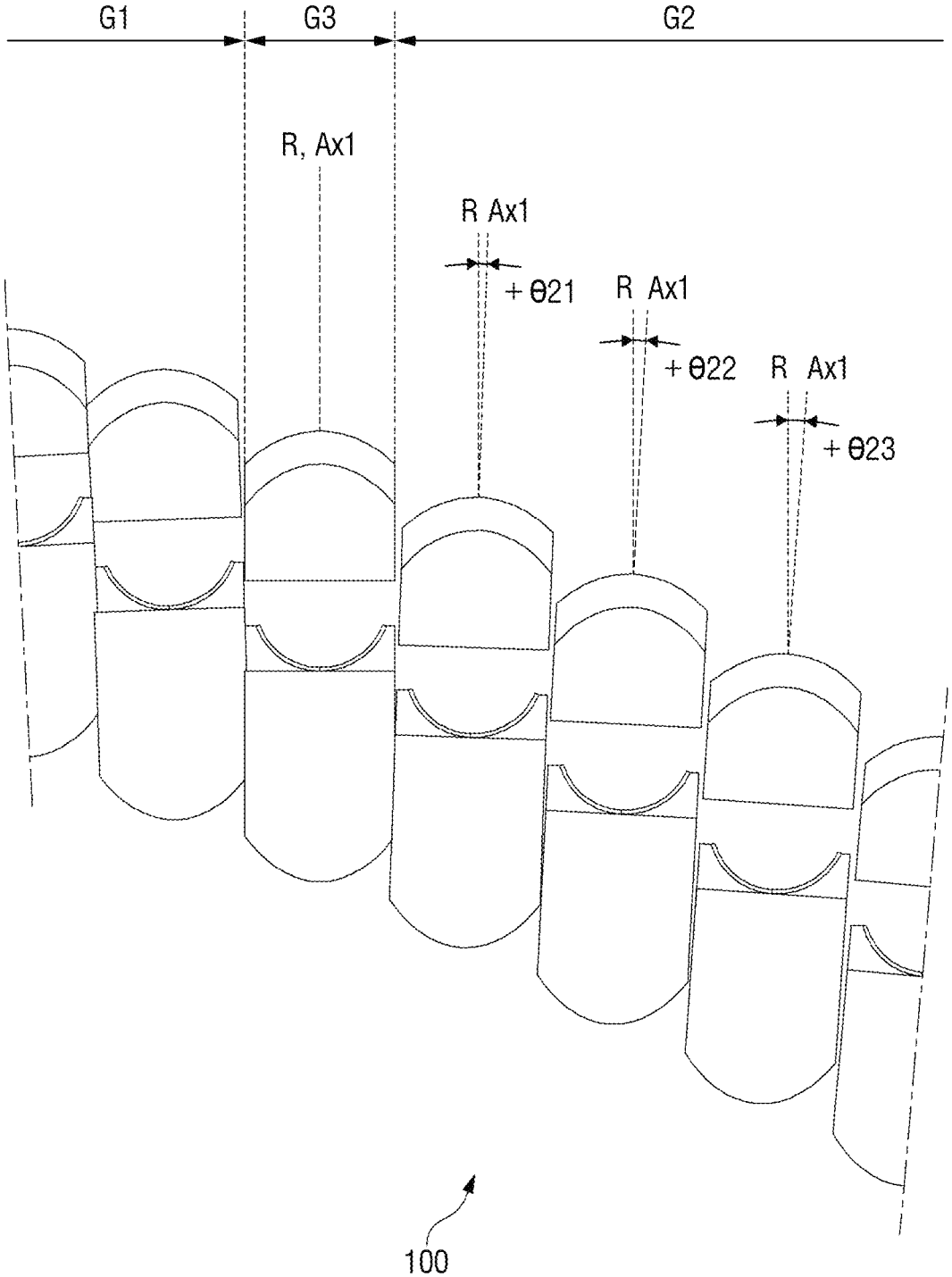
FIG. 9 is a schematic view illustrating optical axes of first lamp modules included in a second group of the first lamp unit according to the exemplary embodiment of the present disclosure.
Figure 10:
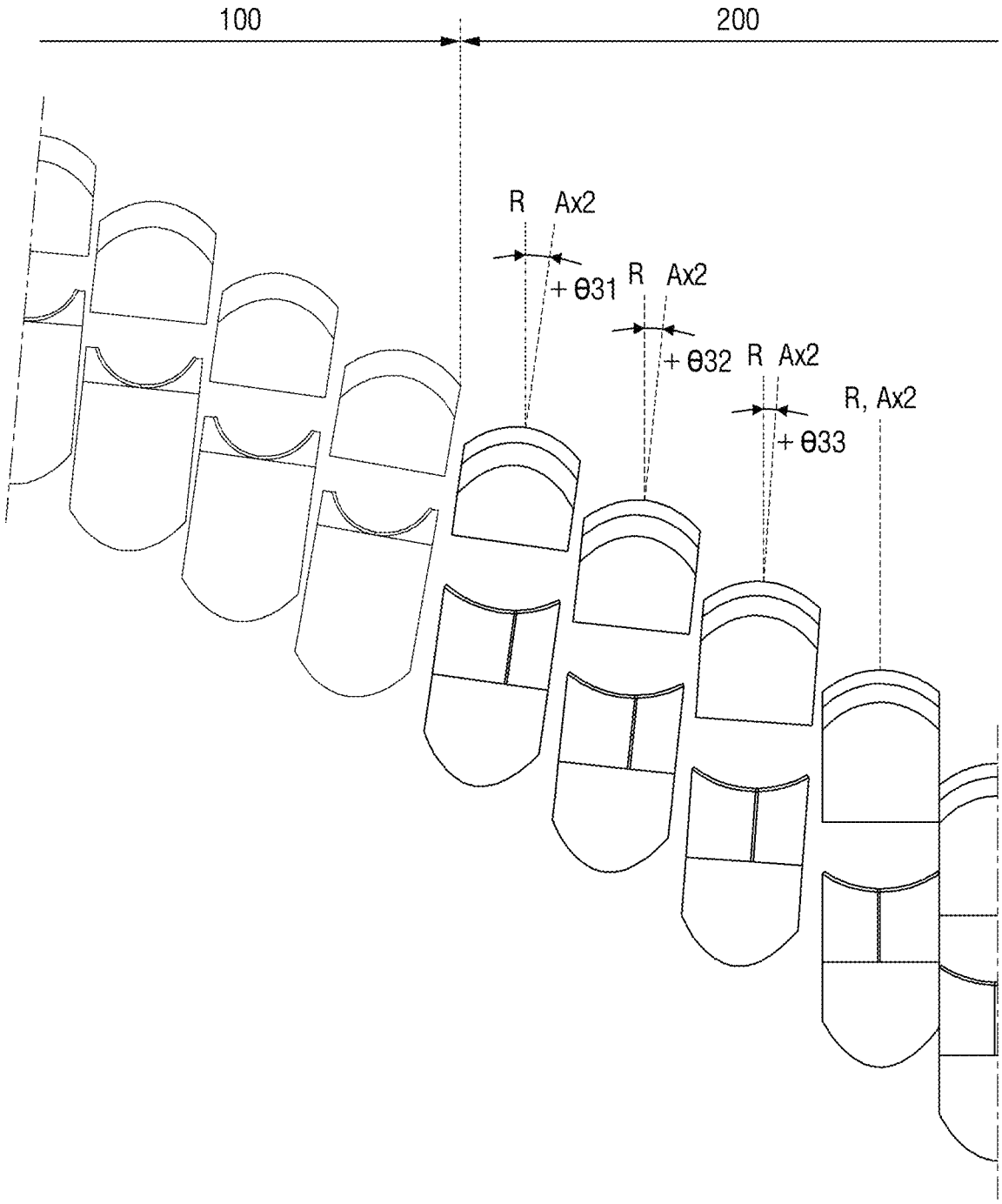
FIG. 10 is a schematic view illustrating an optical axis of a second lamp module according to an exemplary embodiment of the present disclosure.

FIG. 8 is a schematic view illustrating the optical axes of the first lamp modules included in the first group of the first lamp unit according to the exemplary embodiment of the present disclosure, and FIG. 9 is a schematic view illustrating the optical axes of the first lamp modules included in the second group of the first lamp unit according to the exemplary embodiment of the present disclosure.

Referring to FIG. 8, since the optical axes Ax1 of the first lamp modules belonging to the first group G1 are tilted by greater angles in the direction toward the inner side of the vehicle with respect to the reference direction R as they approach the inner side of the vehicle, the angles between the optical axes Ax1 of the first lamp modules 110 and the reference direction R may gradually increase toward the inner side of the vehicle so that a relationship of $-\theta 11<-\theta 12<-\theta 13$, in other words, $|\theta 11|<|\theta 12|<|\theta 13|$, may be established.

Referring to FIG. 9, since the optical axes Ax1 of the first lamp modules belonging to the second group G2 are tilted by greater angles in the direction toward the outer side of the vehicle with respect to the reference direction R as they approach the outer side of the vehicle, the angles between the optical axes Ax1 of the first lamp modules 110 and the reference direction R may gradually increase toward the outer side of the vehicle so that a relationship of $+\theta 21<+\theta 22<+\theta 23$ may be established.

FIGS. 8 and 9 show some of the first lamp modules belonging to the first group G1 and the second group G2, and the remaining first lamp modules may also be configured to have the features described with reference to FIGS. 8 and 9.

Meanwhile, in the exemplary embodiment of the present disclosure, the third group G3 may be disposed between the first group G1 and the second group G2, and among the plurality of first lamp modules 110, the optical axis Ax1 of the lamp module belonging to the third group G3 may be disposed parallel to the reference direction R. Due to such a configuration, a visibility distance in front of the vehicle may be more effectively secured. However, the present disclosure is not limited thereto, and the third group G3 of the first lamp unit 100 may be omitted so that the first group G1 and the second group G2 are disposed adjacent to each other in the vehicle width direction.

The plurality of second lamp modules 210 of the second lamp unit 200 may be configured similarly to the plurality of first lamp modules 110 described above, and the detailed description of the configuration thereof will be omitted.

One or more of the second lamp modules of the plurality of second lamp modules 210 that are disposed in the innermost region adjacent to the first lamp unit 100 may be configured so that optical axes Ax2 of the one or more of the second lamp modules are tilted by smaller angles in the outward direction of the vehicle with respect to the reference direction R compared to the outermost first lamp module of the first lamp unit 100.

In other words, the second lamp unit 200 may form the high brightness region A1 of the low beam pattern, and accordingly, more concentrated may be needed. However, since, among the plurality of first lamp modules 110, the optical axes Ax1 of the first lamp modules disposed at the end portion adjacent to the second lamp unit 200 are tilted toward the outer side of the vehicle with respect to the reference direction R, if the optical axes Ax2 of the second lamp modules adjacent to the first lamp unit 100 are disposed parallel to the reference direction R, a perception of incoherence (e.g., discontinuity) may occur between the first lamp unit 100 and the second lamp unit 200.

To overcome such a potential program, in the exemplary embodiment of the present disclosure, angles by which the optical axes Ax2 of the second lamp modules 210 are tilted in the second direction with respect to the reference direction R may gradually decrease toward the outer side of the vehicle from the end of the first lamp unit 100, to prevent the occurrence of the perception of incoherence between the first lamp unit 100 and the second lamp unit 200. Accordingly, a relationship of $+\theta 31>+\theta 32>+\theta 33$ may be established.

In the exemplary embodiment of the present disclosure, among the plurality of second lamp modules 210, three second lamp modules disposed adjacent to the first lamp unit 100 may be configured so that the optical axes Ax2 of the three second lamp modules are tilted with respect to the reference direction R, and the remaining second lamp modules may be configured so that the optical axes Ax2 of the remaining second lamp modules are parallel to the reference direction R. However, this configuration is only an example to facilitate understanding of the present disclosure, and the present disclosure is not limited thereto. Among the plurality of second lamp modules 210, the optical axes Ax2 of at least one second lamp module disposed adjacent to the first lamp unit 100 may be configured to be tilted with respect to the reference direction R to prevent the perception of incoherence between the first lamp unit 100 and the second lamp unit 200, and the tilting angles may decrease gradually toward the outer side.

As described above, even when some of the plurality of first lamp modules 110 are tilted toward one of two sides with respect to the reference direction R, and some of the plurality of second lamp modules 210 are tilted toward one of two sides with respect to the reference direction R, the cutoff line of the beam pattern formed by the vehicle lamp 1 of the present disclosure may be formed at a correct position by varying the position of the stepped portion 113*a* as described above with reference to FIG. 7.

Figure 11:
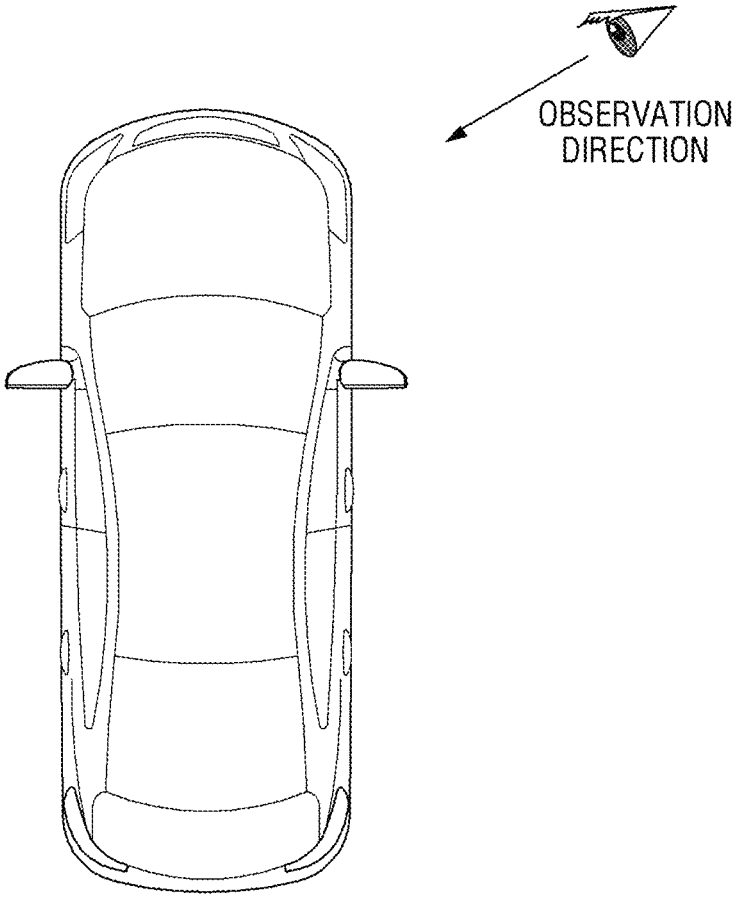
FIG. 11 is a schematic view illustrating a direction from which the vehicle lamp according to the exemplary embodiment of the present disclosure is observed.

FIG. 11 is a schematic view illustrating a direction from which the vehicle lamp according to the exemplary embodiment of the present disclosure is observed, and FIG. 12 is a schematic view illustrating a lighting image viewed from the observation direction of FIG. 11.

Referring to FIGS. 11 and 12, in case two sides of the plurality of first lamp modules 110 are tilted in opposite directions, when the vehicle lamp 1 of the present disclosure is viewed from a front-right side of the vehicle, it can be seen that a substantially whole lighting image I may be observed from the vehicle lamp 1 of the present disclosure. On the other hand, a lighting image I' that corresponds to a case in which the optical axes Ax1 and Ax2 of the plurality of first lamp modules 110 and the plurality of second lamp modules 210 are parallel to the reference direction R may be observed to be less than whole.

In FIGS. 11 and 12, an example in which the vehicle lamp 1 of the present disclosure is viewed from the front-right side of the vehicle has been described. However, the present disclosure is not limited thereto, and the description may be similarly applied when the vehicle lamp 1 of the present disclosure is viewed from various directions.

As described above, in the vehicle lamp 1 of the present disclosure, among the plurality of first lamp modules 110, the optical axes of the first lamp modules disposed at one side forming the spread region of the low beam pattern may be tilted in the directions opposite to the directions by which the optical axes of the first lamp modules disposed at the other side thereof are tilted. Accordingly, not only the spread characteristics can be improved, but also a more complete lighting image can be realized regardless of the viewing angles, and thus degradation of an exterior design can be prevented.

According to a vehicle lamp of the present disclosure described above, one or more advantages may be achieved as follows. Since one or more of a plurality of lamp modules disposed in a width direction of the vehicle are tilted by predetermined angles, a slim form factor may be implemented more easily, and an optimum beam pattern may be formed, allowing sufficient visibility to be secured. In addition, since the one or more of the plurality of lamp modules disposed in the width direction of the vehicle are tilted by the predetermined angles, a more complete lighting image can be observed even when a viewing direction from the outside varies. Effects and advantages of the present disclosure are not limited to those described above, and other effects and advantages will be clearly understood by those skilled in the art through the appended claims.

In concluding the detailed description, those skilled in the art will appreciate that many variations and modifications can be made to the exemplary embodiments without substantially departing from the principles of the present disclosure. Therefore, the disclosed exemplary embodiments of the disclosure are used in a generic and descriptive sense only and not for purposes of limitation.

What is claimed is:

1. A vehicle lamp comprising:

a first lamp unit that forms a spread region of a low beam pattern, wherein the first lamp unit includes a plurality of first lamp modules arranged along a width direction of a vehicle; and a second lamp unit that is disposed more outward than the first lamp unit along the width direction of the vehicle and forms a higher brightness region of the low beam pattern, the higher brightness region having a higher brightness than the spread region, wherein the second lamp unit includes a plurality of second lamp modules arranged along the width direction of the vehicle, wherein the plurality of first lamp modules are divided into a first group and a second group, wherein the first group includes one or more first lamp modules disposed closer to an inner side of the vehicle, and the second group includes one or more first lamp modules disposed closer to an outer side of the vehicle along the width direction of the vehicle, and wherein optical axes of the first lamp modules belonging to the second group are tilted toward the outer side with respect to a reference direction, which is a front-rear direction of the vehicle.

2. The vehicle lamp of claim 1, wherein optical axes of the first lamp modules belonging to the first group are tilted toward the inner side with respect to the reference direction.

3. The vehicle lamp of claim 2, wherein the first lamp modules belonging to the first group are configured with tilting angles toward the inner side that progressively increase toward the inner side of the vehicle, and wherein the first lamp modules belonging to the second group are configured with tilting angles toward the outer side that progressively increase toward the outer side of the vehicle.

4. The vehicle lamp of claim 1, wherein one or more of the plurality of first lamp modules are included in a third group, which is disposed between the first group and the second group, and wherein an optical axis of the first lamp module belonging to the third group is parallel to the reference direction.

5. The vehicle lamp of claim 1, wherein optical axes of one or more second lamp modules disposed adjacent to the first lamp unit, among the plurality of second lamp modules, are tilted by smaller angles toward the outer side with respect to the reference direction than a first lamp module disposed adjacent to the second lamp unit, among the plurality of first lamp modules.

6. The vehicle lamp of claim 1, wherein, among the plurality of second lamp modules, one or more second lamp modules adjacent to the first lamp unit are configured so that optical axes of the one or more second lamp modules have tilting angles toward the outer side with respect to the reference direction that progressively decrease toward the outer side of the vehicle.

7. The vehicle lamp of claim 1, wherein the plurality of first lamp modules and the plurality of second lamp modules are disposed progressively more rearward going toward the outer side of the vehicle.

8. The vehicle lamp of claim 1, wherein each of the plurality of first lamp modules and the plurality of second lamp modules includes:

a light source component that generates light;

a lens component that transmits the light generated from the light source component; and a shield component that obstructs at least a part of the light that travels from the light source component toward the lens component.

9. The vehicle lamp of claim 8, wherein the shield component includes a stepped portion on a surface that obstructs the light such that the surface has two sides having different heights, and wherein the stepped portion is disposed with a predetermined offset in one direction from an optical axis of the lens component based on an angle by which the optical axis of the lens component is tilted with respect to a reference direction.

10. The vehicle lamp of claim 8, wherein the plurality of first lamp modules and the plurality of second lamp modules are disposed progressively more rearward going toward the outer side of the vehicle, and wherein lens components in the plurality of first lamp modules and the plurality of second lamp modules have front-to-rear thicknesses that progressively increase going toward the outer side of the vehicle.

* * * * *